US008232941B2

(12) United States Patent
Yeo et al.

(10) Patent No.: US 8,232,941 B2
(45) Date of Patent: Jul. 31, 2012

(54) LIQUID CRYSTAL DISPLAY DEVICE, SYSTEM AND METHODS OF COMPENSATING FOR DELAYS OF GATE DRIVING SIGNALS THEREOF

(75) Inventors: Jang-Hyun Yeo, Seoul (KR); Woo-Chul Kim, Uijeongbu-si (KR); Jae-Hyoung Park, Yongin-si (KR)

(73) Assignee: Samsung Electronics Co., Ltd. (KR)

( * ) Notice: Subject to any disclaimer, the term of this patent is extended or adjusted under 35 U.S.C. 154(b) by 1115 days.

(21) Appl. No.: 11/931,549

(22) Filed: Oct. 31, 2007

(65) Prior Publication Data

US 2008/0136756 A1 Jun. 12, 2008

(30) Foreign Application Priority Data

Dec. 11, 2006 (KR) ..... 10-2006-0125334

(51) Int. Cl.
*G09G 3/36* (2006.01)

(52) U.S. Cl. ..... 345/87; 345/100; 345/204; 345/208; 345/211; 345/99

(58) Field of Classification Search ..... 345/100, 345/204, 87; 315/169.1
See application file for complete search history.

(56) References Cited

U.S. PATENT DOCUMENTS 5,602,560 A * 2/1997 Ikeda ..... 345/94
5,610,667 A * 3/1997 Hush ..... 348/796
6,194,244 B1 * 2/2001 Yamaguchi et al. ..... 438/57
6,369,808 B1 * 4/2002 Kashiwada ..... 345/204
6,894,673 B2 * 5/2005 Koga et al. ..... 345/99
6,894,674 B2 * 5/2005 Nakajima et al. ..... 345/100
7,015,903 B2 * 3/2006 Lee ..... 345/212
2003/0160753 A1 * 8/2003 McCartney ..... 345/99
2004/0239610 A1 * 12/2004 Ishii ..... 345/100
2005/0174344 A1 * 8/2005 La ..... 345/208
2006/0012589 A1 * 1/2006 Hsieh et al. ..... 345/204
2008/0174539 A1 * 7/2008 Hu et al. ..... 345/99

FOREIGN PATENT DOCUMENTS

JP 2005128384 A * 5/2005

OTHER PUBLICATIONS

Kim, A New Driving Method to compensate for Row Line Signal Propagation Delays in an AMLCD, 2004, S.I.D 280-283.*

* cited by examiner

*Primary Examiner* — Grant Sitta
(74) *Attorney, Agent, or Firm* — Innovation Counsel LLP

(57) ABSTRACT

A liquid crystal display device includes a gate driving shift register having symmetrically split circuit portions by which each of plural gate lines is dually driven from both ends of the gate line during ripple-through scanning of rows of the LCD device. The LCD device includes a timing controller generating an output enable signal and a gate clock, where the timing controller adjusts a timing of a load signal for deciding a data output timing point when data will be loaded into a currently activated display row. The data output timing point is a function of a delay measuring feedback signal that is used to measure the cumulative delays of the sequentially connected stages of the shift register.

10 Claims, 9 Drawing Sheets

LIQUID CRYSTAL DISPLAY DEVICE, SYSTEM AND METHODS OF COMPENSATING FOR DELAYS OF GATE DRIVING SIGNALS THEREOF

CROSS-REFERENCE TO RELATED APPLICATION

This application claims priority to and benefit of Korean Patent Application No. 10-2006-0125334 filed in the Korean Intellectual Property Office on Dec. 11, 2006, the entire disclosure of which is incorporated herein by reference.

FIELD OF INVENTION

The present disclosure of invention relates to a liquid crystal display device, and more particularly, to a liquid crystal display (LCD) device that includes means for decreasing delays of pulsed gate driving signals thereof.

DISCUSSION OF RELATED ART

Generally, a liquid crystal display ("LCD") device has an LCD panel for displaying a video image, a data driving unit for generating data-line signals of the LCD panel, and a gate driving unit for generating gate-line signals of the LCD panel. The LCD panel includes a plurality of gate lines, a plurality of intersecting data lines, and a plurality of pixels. Each of the pixels typically includes a thin film transistor ("TFT") and a pair of opposed electrode areas that define a liquid crystal capacitor. The data driving unit outputs its data signals (usually analog signals) to respective data lines of the panel and the gate driving unit outputs its gate driving signals (usually pulsed digital signals) to respective gate lines of the panel.

The gate driving unit is typically formed on the LCD panel by a same fabrication process as is used for the TFTs. The data driving unit typically has a chip type configuration whose chip or packaging is connected to a peripheral area of the LCD panel. The gate driving unit typically includes a shift register having a plurality of stages. Each of the stages is connected to a corresponding one of the gate lines and outputs a corresponding gate driving pulse or signal.

The gate driving unit is structured to sequentially output a gate line activating pulse that appears to cascade down the rows of the display panel and to thereby scan through the rows, one row at a time. The stages of the shift register are serially interconnected so that an input terminal of a current (Nth) stage is connected to an output terminal of a previous stage (N−1th) and so that an output terminal of a next stage (N+1th) is connected to a control terminal of the current (Nth)stage. Moreover, a start signal is inputted to a first one (N=1) of the plurality of stages to initiate the sequential scanning of the rows by a down-moving gate pulse.

In one embodiment, the above-configured gate driving unit is provided as left and right circuit portions respectively disposed on the left and right sides of the LCD panel. In one particular design, the left gate driving circuit portion drives only the odd-numbered gate lines, while a right gate driving circuit portion drives only the even-numbered gate lines. Thus, the gate driving unit of the one particular design is operated as a single driving system even though it has portions disposed at the left and right sides of the display panel.

Such a single driving system with split left and right portions sometimes has a problem in that artifacts in the form of left and right side horizontal lines or stripes become visible due to gate line propagation delays imposed on gate line activating pulses input form opposing sides of the display by the left and right drive portions. Additional delays may be imposed on gate line activating pulses by so-called ASG (amorphous silicon gate) delays.

By gate line delay, what is meant here is that the gate driving signals alternately applied from the left and right gate driving circuit portions are differently delayed as they propagate into a front portion and then toward the end of the corresponding gate line. The gate line delay may cause a pixel connected to a far end of a gate line to have insufficient time for charging to a desired pixel electrode voltage (corresponding to the data line voltage), thereby reducing luminance of the corresponding pixel. In such a case, a luminance difference between two gate lines adjacent to each other is generated at the left or right sides of the neighboring gate lines, which causes the horizontal lines or stripes visibility phenomenon to undesirably appear at the left and right margins of the display.

By the ASG delay, what is meant here is that a gate driving pulse signal is sometimes applied to the gate of a given TFT later in time than a corresponding data output time slot that is to be associated with the gate driving pulse, this being due to delay variations in gate driving circuit itself where the gate driving circuit is designed to sequentially apply the gate driving pulse signal to a plurality of gate lines one after the next in open loop manner. So, there occurs a problem that a pixel connected to an Nth gate line located at a lower part of an LCD panel has a luminance lower than a luminance corresponding to the value of the data signal that is to be originally displayed because the open loop gate driving circuit is not perfectly synchronized with the timings of the data driving circuit and vise versa. For instance, in case that a data signal of a green level (G) and a data signal of a blue level (B) are respectively provided by a data line driving unit in respective time slots associated with the data driving unit, if a gate driving signal is sequentially applied to a plurality of gate lines, there occurs a problem that the displayed luminance of the blue level (B) gets lower than what level of blue (B) was supposed to be originally displayed by a data signal representing the blue level (B) as one moves toward a lower part of an LCD panel.

SUMMARY

In accordance with the disclosure, a liquid crystal display and a method of decreasing delay problems of a gate driving unit thereof are provided where each gate line is dually driven from both ends by providing gate driving circuit portions at both ends of each of the gate lines and where the synchronization delay problem between the gate driving and data line driving circuits is compensated for by feeding back a reset signal of the gate driving circuit.

In one exemplary embodiment, a liquid crystal display device includes a timing controller generating an output enable signal and a gate clock signal, the timing controller adjusts the timing of a load signal for deciding a data output timing point. The device includes a level shifter that generates a gate clock pulse in response to the output enable signal and the gate clock. The device includes a gate driving circuit that sequentially drives a plurality of gate lines by generating a first gate driving signal in response to the gate clock pulse, and the device includes a clipping unit that provides the timing controller with a second gate driving signal generated by clipping the first gate driving signal, wherein the timing controller measures an actual delay of the gate driving circuit; such as from start of scan of a display frame to the end of the frame and then it calculates a per row delay time associated with stages of the gate driving circuit. The calculated per-row delay time is used to adjust the timing of the load signal according to the number of rows cumulatively scanned during a given frame.

The level shifter generates the gate clock pulse of a gate-on voltage level and a gate-off voltage level.

The gate clock pulse includes a gate clock bar pulse having an inverted phase with respect to a phase of the gate clock pulse.

The first gate driving signal includes a reset signal for resetting the gate driving circuit.

The gate driving circuit is integrated on a liquid crystal display panel having the gate lines formed thereon and is dually formed at both ends of the gate lines to dually drive the data lines.

The gate driving circuit includes a shift register having a plurality of stages serially connected one to the next in a ripple forward manner.

The plurality of stages are connected to the plurality of gate lines, respectively.

The plurality of stages include a dummy stage generating a reset signal that is coupled back to all the stages for resetting them at the end of vertical scan of a display frame.

The timing controller includes an output enable signal generator providing a last output enable signal corresponding to the end of one frame, a counter generating a clock count signal by comparing the clipped reset signal and the last output enable signal of the one frame to thereby determine how far apart from ideal the actual delay is, and a load signal generator for adjusting the timing of the load signal on a per-rows scanned basis and on the basis of the measured ripple-through delay for the whole frame.

In another exemplary embodiment, a liquid crystal display includes a gate driving circuit generating a gate driving signal including a reset signal and a timing controller calculating a delay time of the gate driving signal circuit by comparing the reset signal and an output enable signal corresponding to the reset signal, the timing controller adjusting a timing of a load signal for deciding a data output timing point in response to the delay time.

The liquid crystal display further includes a clipping unit providing the timing controller with a clipped reset signal generated by clipping the reset signal.

The timing controller includes an output enable signal generator providing the output enable signal, a counter generating a clock count signal by comparing the clipped reset signal and a last output enable signal of one frame, and a load signal generator adjusting the timing of the load signal in response to the clock count signal.

The gate driving circuit includes a shift register having a plurality of stages dependently connected to each other and each of the plurality of the stages includes a dummy stage generating the reset signal.

The counter generates as the clock count signal the number of clocks corresponding to an interval from a rising timing point of the output enable signal to a rising timing point of the clipped reset signal.

The load signal generator calculates a delay time of the gate driving signal by dividing the number of gate lines provided on the display by a value of the clock count signal and responsively delays a falling timing point of the load signal corresponding to the calculated delay time of the gate driving signal and corresponding to the number rows scanned thus far when proceeding down one frame.

In another exemplary embodiment, a method of decreasing a delay of a gate driving signal includes a reset signal feedback step of feeding back a reset signal that is an output signal of a dummy stage of a gate driving circuit to a timing controller, a delay time calculating step of calculating a delay time of a gate driving signal generated from the gate driving circuit by comparing the reset signal to an output enables signal corresponding to the reset signal, and a load signal timing adjusting step of adjusting a timing of a load signal for deciding an output timing point of data in response to the delay time.

The reset signal feedback step includes clipping the reset signal to a predetermined voltage level and then feeding back the clipped reset signal to the timing controller.

The delay time calculating step includes generating a clock count signal by counting the number of clocks corresponding to an interval from a rising timing point of the output enable signal to a rising timing point of the clipped reset signal.

The load signal timing adjusting step includes calculating a delay time of the gate driving signal by dividing the number of gate lines provided with the gate driving signal by a value of the clock count signal and delaying a falling timing point of the load signal corresponding to the calculated delay time of the gate driving signal.

It is to be understood that both the foregoing initial description and the following detailed description of the present disclosure of invention are exemplary and explanatory and are intended to provide further explanation rather than limiting constraints.

BRIEF DESCRIPTION OF THE DRAWINGS

The accompanying drawings, which are included to provide a further understanding of the disclosure, illustrate various embodiments. In the drawings.

DETAILED DESCRIPTION

Reference will now be made in detail to the embodiments illustrated in the accompanying drawings. Where practical, the same reference numbers will be used throughout the drawings to refer to same or like parts.

Figure 1:
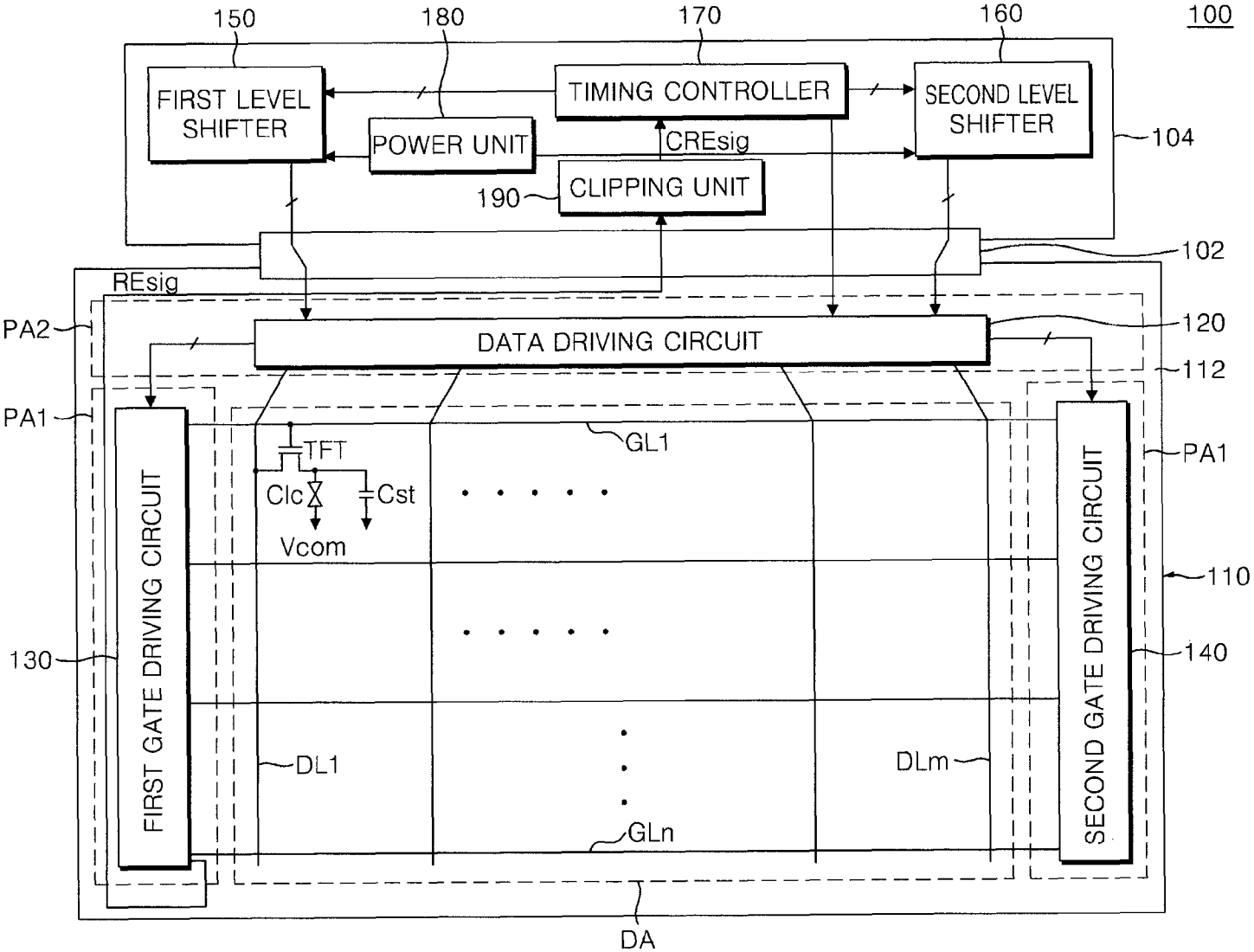
FIG. 1 is a block diagram of an LCD device according to one embodiment of the present disclosure.

FIG. 1 is a block diagram of an LCD device 100 according to one embodiment. The LCD device 100 includes an LCD panel 110, a data driving circuit 120, a first gate driving circuit 130 on the left, a second gate driving circuit 140 on the right, a first level shifter 150 on the left, a second level shifter 160 on the right, a timing controller 170, a power supply unit 180, and a clipping unit 190.

The LCD panel 110 includes a TFT's-containing substrate 112, a color filters containing substrate (not shown), and a liquid crystal material (not shown) inserted between the TFTs substrate 112 and the color filters substrate.

The TFTs substrate 112 includes a display area DA, a first set of peripheral areas PA1, PA1' (on the left and right sides), and a second peripheral area PA2 (on the top). The display area DA is provided with gate lines GL1 to GLn extending therethrough in a first direction, data lines DL1 to DLm extending therethrough in a different second direction, and a plurality of pixels each connected to adjacent ones of the gate lines GL1 to GLn and the data lines DL1 to DLm. The first set of peripheral areas PA1, PA1' are respectively provided with first and second gate driving circuit portions 130 and 140 (on the left and right sides) for driving respective ends of the gate lines GL1 to GLn. And, the data driving circuit 120 for driving the data lines DL1 to DLm is located on the second peripheral area PA2. As mentioned, the first set of peripheral areas PA1, PA1' are positioned adjacent to both ends of the gate lines GL1 to GLn and the second peripheral area PA2 is the area adjacent to one set of ends (i.e., top ends) of the data lines DL1 to DLm.

Each of the pixels, e.g., one pixel includes a corresponding TFT (one shown) connected to the adjacent gate line (e.g., GL1) and to the adjacent data line (e.g., DL1). The equivalent circuit of each pixel may be viewed as including an LCD capacitor $C_{LC}$ connected to a drain terminal of the TFT, and a storage capacitor CST also connected to the same drain terminal. The gate and source of the TFT are respectively connected to the gate line GL1 and the data line DL1. The LCD capacitor $C_{LC}$ includes a pixel electrode (not explicitly shown but understood to be one covering a substantial portion of the pixel area), an opposed portion of a common electrode, and liquid crystal molecules interposed and functioning as a dielectric material between the two electrodes.

The colors filter substrate is typically provided with a black matrix for preventing light leakage between pixel area, a plurality of differently colored color filters (e.g., R, G, B), and a common electrode. As understood by those skilled in the art, liquid crystals are substances having dielectric anisotropy and which may be used to adjust transmissivity of polarized light by being rotated by a difference between a voltage applied to the common electrode and a voltage applied to the pixel electrode.

The first and second gate driving circuits 130 and 140 are integrated on the first set of peripheral areas PA1, PA1' and more particularly, on both opposing sides of the LCD panel 110 as shown to thereby leave the gate lines GL1 to GLn in-between. Respective gate line driving outputs of the first and second driving circuits 130 and 140 are connected to respective ends of each of the gate lines GL1 to GLn. The first and second gate driving circuits 130 and 140 dually drive each of the gates lines GL1 to GLn by supplying gate driving pulses from both ends of each of the gate lines GL1 to GLn where the pulses are sequentially applied to one gate line at a time to thereby effect a vertical scanning operation. At least one of the first and second gate driving circuits, e.g., the left gate driving circuit 130 provides a reset signal, REsig that is used for resetting the gate driving circuit 130 at the end of a vertical frame scan. As shown, this end-of-frame reset signal, REsig is operatively coupled to the clipping unit 190. The clipping unit 190 responsively produces a CREsig signal that is coupled to the timing controller 170 for indicating to the latter controller 170 that gate driving circuit 130 has now output its end-of-frame reset signal, REsig.

The data driving circuit 120 receives a data timing control signal from the timing controller 170, and in response provides a set of analog driving voltages corresponding to the data to be displayed along the currently activated row of pixels, where the provided analog driving voltages are respectively applied to the top ends of the DATA lines DL1 to DLm as predefined gray scale display voltages. In one embodiment, the data driving circuit 120 is implemented with a monolithic integrated chip whose substrate or packaging is loaded on (e.g., bonded to) the second peripheral area PA2 of the TFT substrate 112. Although not all connections are shown, the data driving circuit 120 is connected to the timing controller 170 and to the power supply unit 180 via a flexible printed circuit board 102 connected to the second peripheral area PA2.

Although the data driving circuit 120 of the illustrated embodiment is exemplarily loaded on the TFT substrate 112 by a COG (chip on glass) technique, it can be loaded in various other ways. For instance, it can be loaded by a TCP (tape carrier package) technique. For another instance, it can be directly integrated on the TFT substrate 112 like the first or second gate driving circuit 130 or 140.

The first and second level shifters 150 and 160 receive a gate control signal from the timing controller 170 and a driving voltage from the power supply unit 180, and they generate respective left and right gate driving signals for driving the left and right gate driving circuits 130 and 140.

In addition to the CREsig signal, the timing controller 170 receives a set of digital data signals (e.g., RGB pixel data) and an input control signal from an external unit (not shown), and the timing controller 170 responsively generates a gate control signal and a data control signal, and then supplies the generated control signals to the first and second level shifters 150 and 160 and to the data driving circuit 120. In one embodiment, the data is an RGB video signal. The data control signal includes a load signal, and the input control signal includes a vertical synchronizing signal, a horizontal synchronizing signal, a main clock, and a data enable signal. As already mentioned, the timing controller 170 receives a clipped reset signal (CREsig) from the clipping unit 190. In response to the received clipped reset signal (CREsig), the timing controller 170 adjusts a timing of the load signal provided to the data driving circuit 120.

The power supply unit 180 generates an analog driving voltage, a common voltage VCOM, and a gate driving voltage using a power voltage supplied from an external unit. The power supply unit 180 supplies the analog driving voltage to the data driving circuit 120. The power supply unit 180 supplies the common voltage VCOM to the common electrode of the LCD panel 110. And, the power supply unit 180 supplies the gate driving voltage to the first and second level shifters 150 and 160.

The clipping unit 190 receives a reset signal REsig from the first gate driving circuit 130, clips the received signal, and then provides the clipped reset signal CREsig to the timing controller 170.

The clipped reset signal CREsig is the signal resulting from restricting the reset signal REsig to a voltage level that can be handled by the timing controller 170. The reset signal REsig is the signal of a gate-on voltage VON or gate-off voltage VOFF outputted from a dummy stage of the gate driving circuit 130 to reset the first gate driving circuit 130 at the end of each vertical scan of the display. Thus the reset signal REsig can be combined with the start of scan signal (vertical synch signal) to indicate the cumulative delay of the first gate driving circuit 130 in its operation of sequentially activating all of the display rows, one after the next. Then the per-line delay can be calculated by dividing the measured delay by the total number of scanned lines. It is to be understood that although one is not shown an appropriate arithmetic logic unit or microcontroller or microprocessor may be used for generating the calculated per-row correction amount and that such a calculating means is provided with a number indicating the predetermined number of rows in the given display. Note that the output of the dummy STAGE(n+1) is loaded by the Reset inputs of all the stages as well as by the input of clipping circuit 190. It is desirable but not necessary to load the output of the dummy STAGE(n+1) to have an approximately same load as that of the other stages. To this end, the gate line (GL(n+1)) of the dummy STAGE(n+1) may have a same or lesser number of dummy gate pads attached to it as may be appropriate for approximately simulating the output loadings on the other stages.

In one embodiment (see FIG. 9*c*), the clipping unit 190 includes a clipping circuit for outputting a clipped reset signal CREsig by restricting respective high and low amplitudes of a reset signal REsig having the gate-on voltage VON and the gate-off voltage VOFF to 3.3V level and to ground. Those skilled in the art have numerous acceptable designs to choose from for implementing the clipping circuit that performs this function (see FIG. 9*c*). So, details of a specific clipping circuit are omitted here.

In one embodiment, the timing controller 170, the first and second level shifters 150 and 160, the power supply unit 180 and the clipping unit 190 are mounted on a control printed circuit board 104. The control printed circuit board 104 is connected to the second peripheral area PA2 of the TFT substrate 112 via the flexible printed circuit board 102. The first and second gate driving circuits 130 and 140 provided to the LCD panel 110 are connected to the timing controller 170 and the power supply unit 180 via the data driving circuit 120 or can be directly connected to the timing controller 170 and the power supply unit 170 via the flexible printed circuit board 102.

Figure 2:
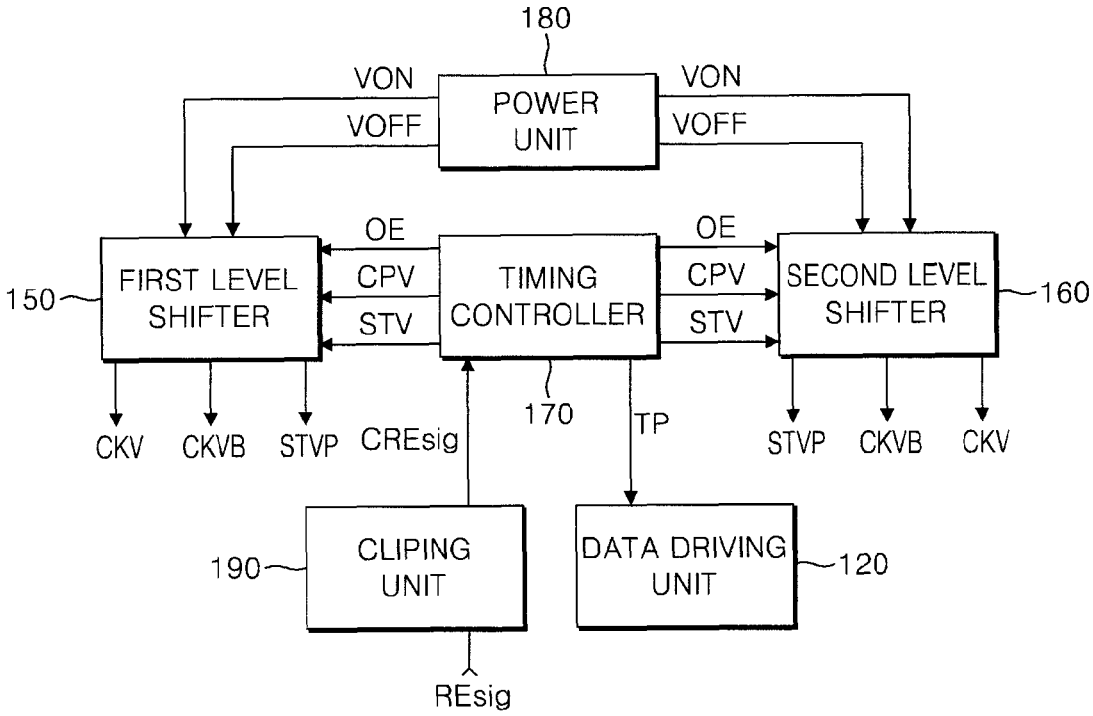
FIG. 2 is a block diagram to explain an input/output signal relation of a timing controller shown in FIG. 1.

FIG. 2 is a block diagram to explain in more detail an input/output signal relation of a timing controller 170 in one embodiment according to FIG. 1.

Referring to FIG. 2, the timing controller 170 provides an output enable signal OE, a gate clock signal CVP, and a gate start signal STV to each of the first and second level shifters 150 and 160. And, the timing controller 170 adjusts a timing of a load signal (TP) and then provides it to the data driving circuit 120 in response to the timing of the clipped reset signal CREsig as received from the clipping unit 190.

Meanwhile, the first and second level shifters 150 and 160 are provided with the gate-on voltage VON and gate-off voltage OFF as the gate line driving voltages by the power supply unit 180 and they are also provided with the output enable signal OE, the gate clock signal CPV, and the gates scan start signal STV as gate control signals by the timing controller 170. The first and second level shifters 150 and 160 generate a corresponding start pulse STVP that transitions between the levels of the gate-on voltage VON and gate-off voltage VOFF, a gate clock pulse CKV, and a gate clock bar pulse CKVB (inverted gate clock). The first and second level shifters 150 and 160 then supply the generated pulses to the first and second gate driving circuits 130 and 140 via the data driving circuit 120.

The gate start signal STV is the signal indicating a start of one frame. The start pulse STVP is the signal for enabling the gate driving circuit 130 or 140 to generate a first gate driving signal in one frame. The gate clock pulse CKV and the inverted gate clock bar pulse CKVB are the clocks having 180 degree phases with respect to each other and are used to synchronize the driving of respective gate lines between the VON and VOFF states.

Figure 3:
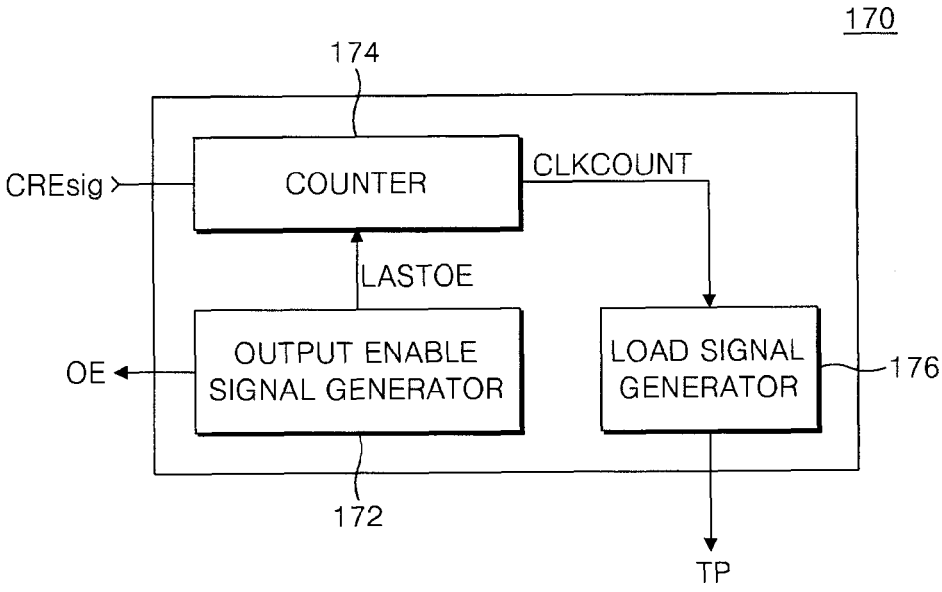
FIG. 3 is a block diagram of a timing controller shown in FIG. 2.

FIG. 3 is a block diagram of an embodiment of the timing controller 170 which may be used in FIG. 2.

Referring to FIG. 3, the illustrated timing controller 170 includes an output enable signal generator 172, a counter 174, and a load signal generator 176.

The output enable signal generator 172 provides a last output enable signal LASTOE of one frame to the counter 174. What is meant here by the last output enable signal LASTOE of one frame is that it corresponds in timing the output enable signal OE used to generate a gate clock pulse CKV provided to an end dummy stage at the end of the serial sequence of live stages used to form the gate lines activating shift register. The dummy stage is fabricated with the same fabrication process used for the other stages of the shift register and thus its response delay is representative of that of the other stages.

Figure 9A:
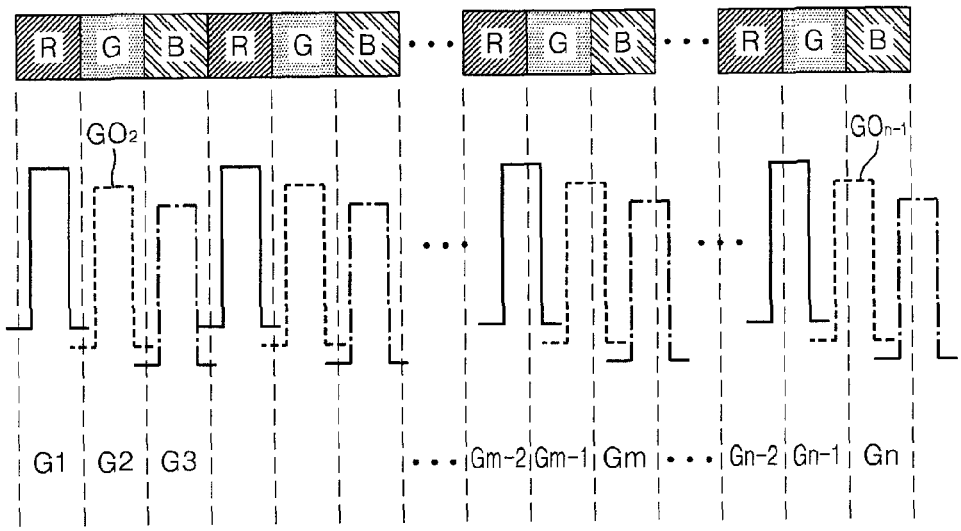
FIGS. 9A to 9D are timing diagrams of signals to explain the ASG delay decreasing method shown in FIG. 8.
Figure 9B:
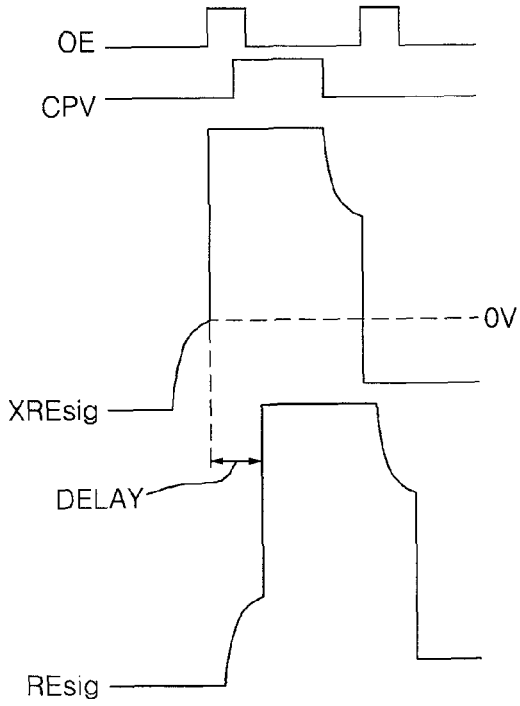
Figure 9C:
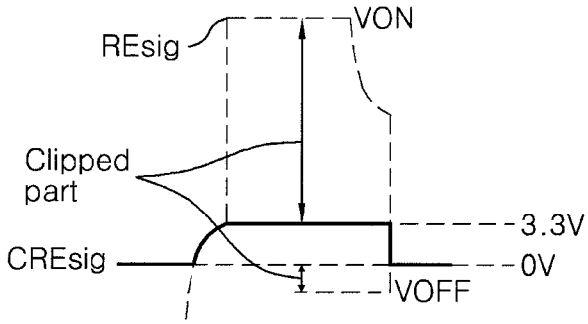
Figure 9D:
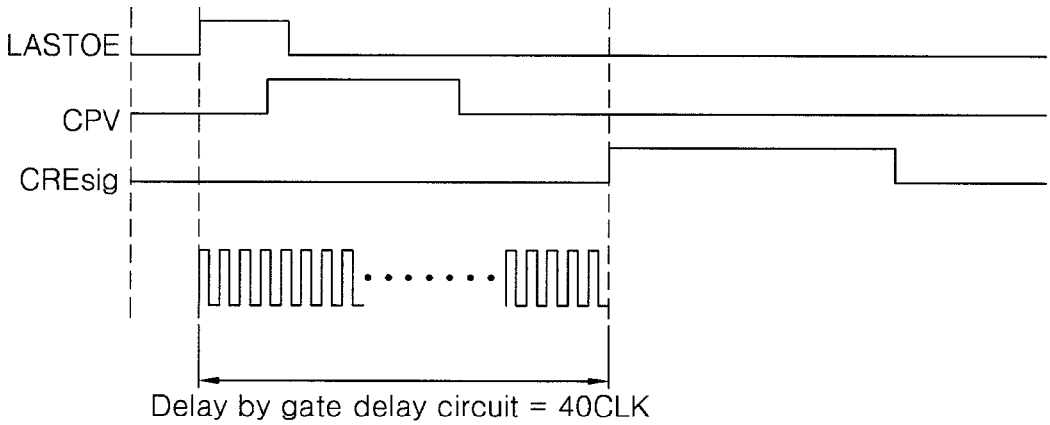

The counter 174 generates a clock counter signal CLOCKCOUNT representing the timing difference between a rising timing point of a clipped reset signal CREsig with a corresponding rising timing point of the last output enable signal LASTOE (see FIG. 9D). The counter 174 then provides the clock counter signal to the load signal generator 176. The clock counter signal CLKCOUNT is the signal resulting from counting the delay time of a gate driving signal in terms of a reference system clock.

The load signal generator 176 adjusts a falling timing point of the load signal TP in response to the clock counter signal CLKCOUNT. This is because the data driving circuit 120 outputs new data for the data lines at the falling timing point of the load signal TP (see FIG. 7).

Since the LCD device according to one embodiment of the present disclosure is able to adjust the load time (e.g., falling edge of the TP pulse) so as to compensate for an output delay of a gate driving signal by the gate driving circuit in a manner of having a representative reset signal (REsig) of the gate driving circuit fed back to it, the exemplary design is able to solve the problem that luminance becomes lower than that of data originally displayed by a pixel connected to a gate line provided to a lower part of an LCD panel due to a gate driving signal applied later than a data output according to a delay of the gate driving circuit itself.

Figure 4:
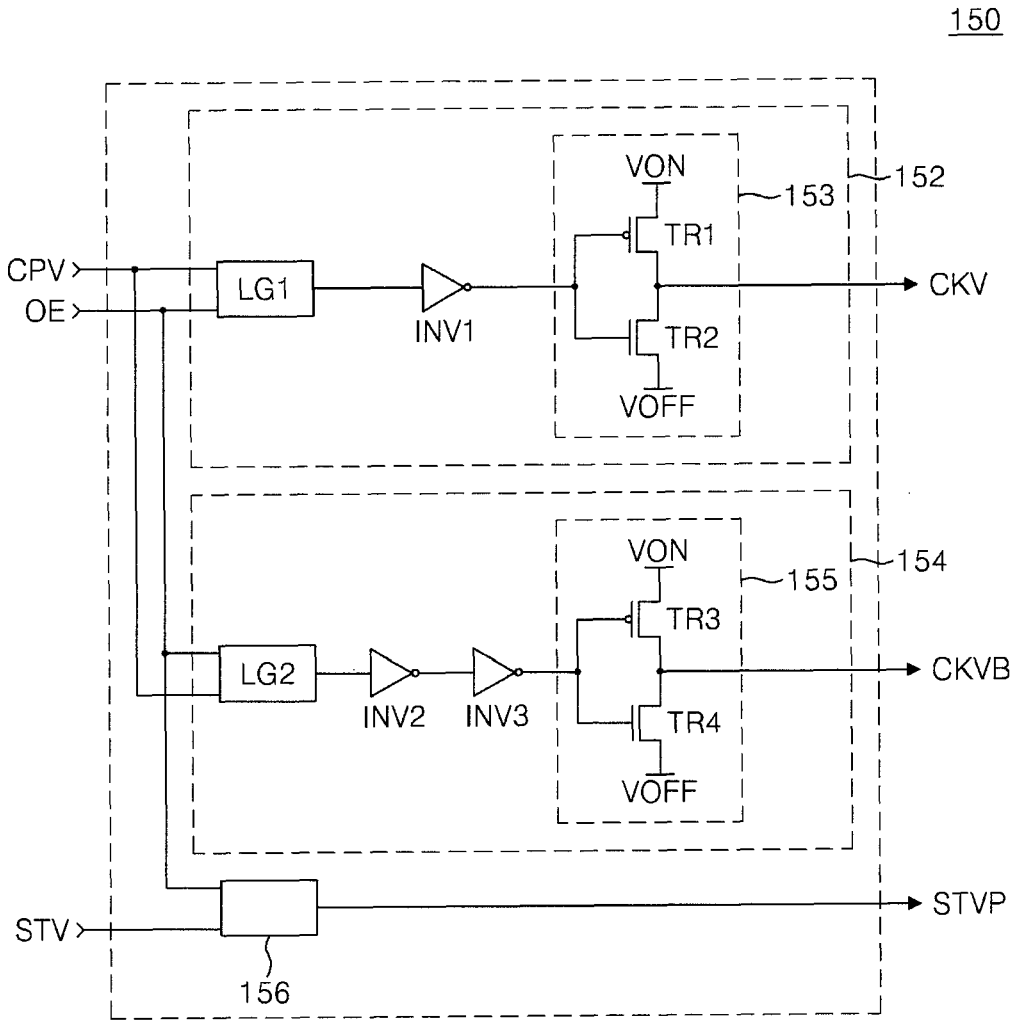
FIG. 4 is a circuit diagram of a first level shifter shown in FIG. 1.

FIG. 4 is a circuit diagram of an embodiment for the first level shifter shown in FIG. 1. The first level shifter 150 includes a first level shifting unit 152, a second level shifting unit 154, and a third level shifting unit 156.

The first level shifting unit 152 generates a gate clock pulse CKV that transitions between VON and VOFF and is supplied to the first gate driving circuit. The level-shifted clock pulse CKV is generated by performing a first logical operation, LG1 (i.e., OR, AND, etc.) on an output enable signal, OE and a supplied gate clock signal, CPV and amplifying the high and low voltage levels. For this, the first level shifting unit 152 includes a logical operation unit LG1, a driving inverter INV1, and a full swing CMOS inverter 153 as shown.

In one embodiment, the first logical operation unit LG1 performs an OR operation on the output enable signal OE and the gate clock signal CPV. The driving inverter INV1 inverts the output of the logical operation unit LG1 and then amplifies it into a driving level of the full swing inverter 153. The full swing inverter 153 inverts the clock signal a second time and generates a gate clock pulse CKV at a level of a gate-on/off voltages VON/VOFF in response to an output of the driving inverter INV1.

The second level shifting unit 154 supplies a gate clock bar pulse CKVB to the first gate driving circuit by performing a second logical operation LG2 on an output enable signal OE and a gate clock signal CPV and amplifying a voltage level. For this, the second level shifting unit 154 includes a logical operation unit LG2, a logical inverter INV2, a driving inverter INV3, and a full swing inverter 155. The gate clock bar signal CKVB is a clock resulting from inverting a phase of the gate clock pulse CKV.

The logical operation unit LG2 performs an OR operation on the output enable signal OE and the gate clock signal CPV. The logic inverter INV2 inverts to output an output of the logical operation unit LG1. The driving inverter INV3 inverts a phase of an output of the inversion inverter INV2 and then amplifies it to a driving level of the full swing inverter 155. The full swing inverter 155 generates a gate clock bar pulse CKVB at a level of a gate-on/off voltage VON/VOFF in response to an output of the driving inverter INV3.

The third level shifting unit 156 receives an output enable signal OE and a gate start signal STV and then generates a start pulse STVP at a level of a gate-on/off voltage VON/VOFF. The start pulse STVP has the same cycle and pulse width as a gate start pulse STV and has a level of a gate-on/off voltage VON/VOFF. This may be accomplished with a circuit similar to 152 except that LG1 is replaced with an AND function.

The configuration of the second level shifter 160 is substantially the same as the configuration of the first level shifter 150 and further detailed description thereof is therefore omitted for brevity.

Figure 5:
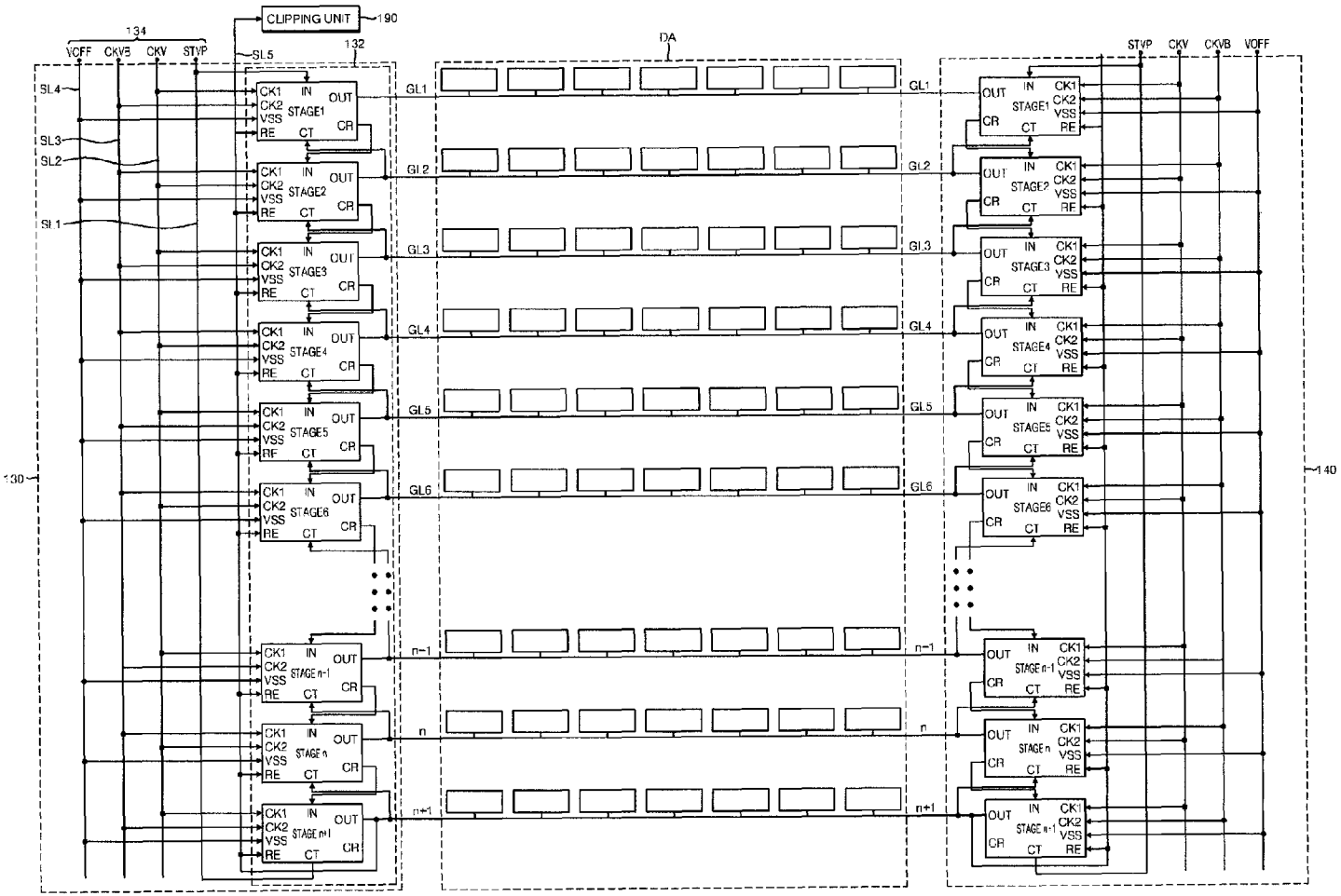
FIG. 5 is a block diagram of first and second gate driving circuits shown in FIG. 1.

FIG. 5 is a block diagram of a detailed implementation for the first and second gate driving circuits shown in FIG. 1.

Referring to FIG. 5, the first and second gate driving circuits 130 and 140 are arranged adjacent to both sides of a display area DA to dually drive the operational gate lines GL1 to GLn, respectively. However, as seen, there is one additional gate line, $GL_{n+1}$ and one extra drive stage (n+1) on each side. The first and second gate driving circuits 130 and 140 have a symmetric structure based on the gate lines GL1 to GLn.

The first gate driving circuit 130 includes an interconnect lines unit 134 and a circuit unit 132. The lines unit 134 receives various signals from a data driving unit and then supplies the received signals to the circuit unit 132. The circuit unit 132 sequentially outputs gate driving signals for activating the gate lines GL1 through GLn and then GLn+1 one after the other in response to the various signals delivered via the lines unit 134.

The circuit unit 132 includes a shift register having a plurality of stages STAGE1 to STAGEn+1 that are serially connected one to the next as shown. The first to $n^{th}$ stages of STAGE1 to STAGEn+1 are electrically connected to the first to $n^{th}$ gate lines GL1 to GLn to sequentially output the gate driving signals, respectively. In this case, the $(n+1)^{th}$ stage STAGEn+1 is a dummy stage. In one embodiment, n is an even number.

Each of the n+1 stages, STAGE1 to STAGEn+1 includes a first clock terminal CK1, a second clock terminal CK2, an input terminal IN, a control terminal CT, an output terminal OUT, a reset terminal RE, a carry terminal CR, and a ground voltage terminal VSS.

For the odd-numbered stages, STAGE1, STAGE3, . . . , and STAGEn+1 (assuming n is even), the noninverted gate clock pulse CKV is provided to the first clock terminal CK1 and the inverted gate clock bar pulse CKVB is provided to the second clock terminal CK2. For the even-numbered stages STAGE2, STAGE4, . . . , and STAGEn (assuming n is even), the inverted gate clock bar pulse CKVB is provided to the first clock terminal CK1 and the noninverted gate clock pulse CKV is provided to the second clock terminal CK2.

In the stages STAGE2 to STAGEn+1, the input terminal IN of a Jth stage is connected to the carry terminal CR of a previous (J−1) stage so as to be provided with a carry signal of the previous stage. The IN terminal of stage1 receives the STVP signal. The control terminal CT of each Jth stage is connected to the output terminal OUT of a next (J+1) stage so as to be provided with an output signal of the next stage, the exception being Stage(n+1) whose CT terminal connects to the STVP line (SL1). Since the first stage STAGE1 is not provided with the previous stage, the start pulse STVP is provided to the input terminal IN of the first stage STAGE1. The carry signal outputted from the carry terminal CR of each stage drives the IN terminal of the next stage, the exception being Stage(n+1). Also as seen, the output (OUT terminal) of the dummy Stage(n+1) connects to the SL5 line where the latter couples to the Reset terminals of all the stages in unit 130 and also to the input of the clipper 190.

Figure 6:
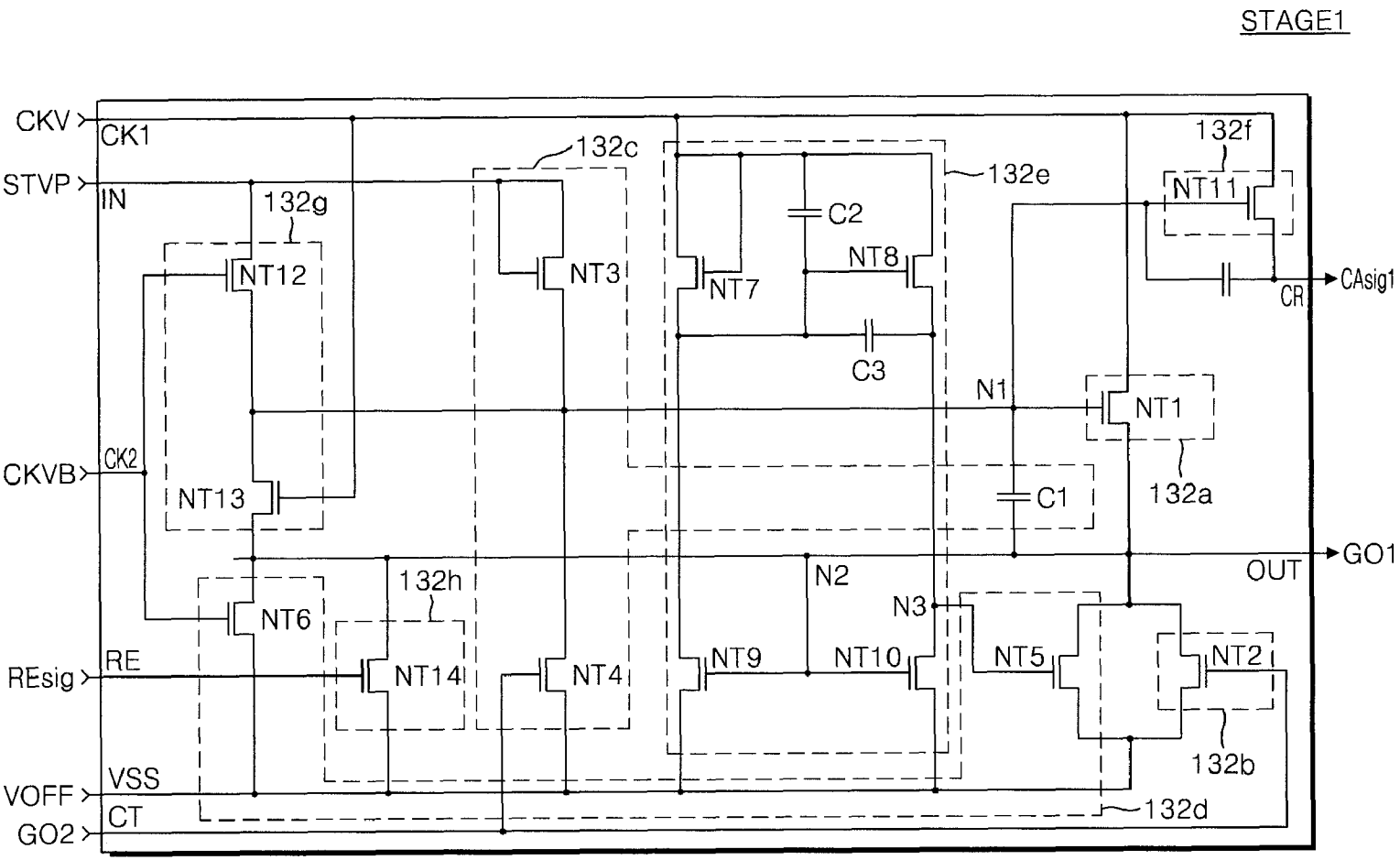
FIG. 6 is an exemplary circuit diagram of a stage of the first gate driving circuit shown in FIG. 5.

Since the start pulse STVP is provided to the control terminal CT of the dummy stage STAGEn+1, the latter STAGEn+1 is blocked from outputting a VON level at startup as shall be understood shortly (see FIG. 6). The OUT terminal of stage STAGEn+1 provides a carry signal to the control terminal CT of the $n^{th}$ stage STAGEn. A gate-off voltage VOFF is provided to the local ground voltage terminal VSS of each of the stages STAGE1 to STAGEn+1. As mentioned, output signal of the $(n+1)^{th}$ dummy stage STAGEn+1 is provided to the reset terminals RE by way of line SL5.

The output terminal OUT of each of the odd-numbered stages STAGE1, STAGE3, . . . , and STAGEn+1 can output a VON level synchronized to the noninverted gate clock pulse CKV as its gate line driving signal and the carry terminal CR can similarly output a VON level synchronized to the noninverted gate clock pulse CKV as its carry signal. The output terminal OUT of the even-numbered stages STAGE2, STAGE4, . . . , and STAGEn can output a VON level synchronized to the inverted gate clock bar pulse CKVB as its gate driving signal and the carry terminal CR can similarly output a VON level synchronized to the inverted gate clock bar pulse CKVB as its carry signal.

In the illustrated structure of the first gate driving circuit 130, each of the odd-numbered stages STAGE1, STAGE3, . . . , and STAGEn+1 is thus synchronized with the noninverted gate clock pulse CKV to output a respective gate driving signal and each of the even-numbered stages STAGE2, STAGE4, . . . , and STAGEn is synchronized with the inverted gate clock bar pulse CKVB to output a respective gate driving signal.

The output terminals OUT of the stages STAGE1 to STAGEn+1 of the first gate driving circuit 130 are connected to the gate lines GL1 to GLn provided to the display area DA, respectively and then sequentially drive the gate lines GL1 to GLn by sequentially supplying the gate driving signals to the gate lines GL1 to GLn.

The lines unit 134 is provided in the vicinity of the circuit unit 132. The lines unit 134 includes a start pulse line SL1, a gate clock pulse line SL2, a gate clock bar pulse line SL3, a ground voltage line SL4, and a reset line SL5, which extend in parallel with each other.

The start pulse line SL1 receives a start pulse STVP from the first level shifter and then inputs the received pulse to the input terminal of the first stage STAGE1 and the control terminal CT of the $(n+1)^{th}$ stage STAGEn+1.

The gate clock line SL2 receives a gate clock pulse CKV from the first level shifter and then provides the received pulse to the first clock terminals CK1 of the odd-numbered stages STAGE1, STAGE3, . . . , and STAGEn+1 and the second clock terminals CK2 of the even-numbered stages STAGE2, STAGE4, . . . , and STAGEn.

The gate clock bar line SL3 receives the inverted gate clock bar pulse CKVB from the first level shifter 150 and provides the received pulse to the second clock terminals CK2 of the odd-numbered stages STAGE1, STAGE3, . . . , and STAGEn+1 and the first clock terminals CK1 of the even-numbered stages STAGE2, STAGE4, . . . , and STAGEn.

The ground voltage line SL4 receives the gate-off voltage VOFF from the power supply unit 180 and then supplies the received voltage to the local ground voltage terminals VSS of the stages STAGE1 to STAGEn+1.

The reset line SL5 provides the output signal of the output terminal OUT of the $(n+1)^{th}$ stage STAGEn+1 as a reset signal REsig to the reset terminals RE of the stages STAGE1 to STAGEn+1. Moreover, the reset line SL5 provides the clipping unit 190 with the output signal of the output terminal OUT of the $(n+1)^{th}$ stage STAGEn+1.

The first and second gate driving circuits 130 and 140 have symmetric structures as shown relative to the gate lines GL1 to GLn. It will be apparent from FIG. 5 to those skilled in the art that the second gate driving circuit 140 can be implemented according to the above description of the first gate driving circuit 130. So, details of the second driving circuit 140 will be omitted in the following description for sake of brevity. The one exception is that the Reset line of the right side circuit portion 140 does not need to connect to clipping unit 190. Of course in an alternate embodiment, clipping unit 190 can receive the Reset pulse of the right side circuit portion 140 instead of that from the left.

The LCD device according to the illustrated embodiment is thus configured to dually drive the gate lines by providing a pair of the equivalent gate driving circuits to both sides of the gate lines, respectively. Hence, the illustrated embodiment is able to overcome the problem of luminance differences between two adjacent gate lines at both ends of the left and right sides of the gate lines due to the gradually delayed outputs of the gate driving signal toward the end of the corresponding gate line in the case where gate lines are driven only from one end and adjacent gate lines are driven from opposite ends.

FIG. 6 is an exemplary circuit diagram of the stage of the first gate driving circuit shown in FIG. 5.

Referring to FIG. 6, the first stage STAGE1 includes an output pull-up unit 132*a* (transistor NT1), an output pull-down unit 132*b* (transistor NT2), a driving unit 132*c*, a holding unit 132*d*, a switching unit 132*e*, and a carry unit 132*f*.

The pull-up unit 132*a* receives its power from the noninverted gate clock pulse CKV as provided via the first clock terminal CK1 and the pull-up unit 132*a* outputs a gate driving signal GO1 via the output terminal OUT where GO1 can go high when CKV goes high. The pull-up unit 132*a* includes a first NMOS transistor NT1 having a gate connected to a first node N1, a drain connected to the first clock terminal CK1, and a source connected to the output terminal OUT. (First capacitor C1 straddles between the gate and source of NT1.)

The pull-down unit 132*b* (NT2) is structured to pull down the gate driving signal GO1 to the VOFF level in response to a going high state of a gate driving signal GO2 provided from the second stage (STAGe2). In the illustrated embodiment, the pull-down unit 132*b* includes a second NMOS transistor NT2 having a gate connected to the control terminal CT, a drain connected to the output terminal OUT, and a source connected to the local ground voltage terminal VSS.

The driving unit 132*c* turns on the pull-up unit 132*a* in response to a start pulse STVP provided via the input terminal IN or turns off the pull-up unit 132*a* in response to the gate driving signal GO2 of the second stage. For this, the driving unit 132*c* includes a buffer unit, a charge unit, and a discharge unit.

The buffer unit includes a third NMOS transistor NT3 in a diode configuration where its gate and drain are commonly connected to the input terminal IN and a source connected for charging up the first node N1. The charge retaining unit includes a first capacitor C1 having a first electrode connected to the first node N1 (gate of NT1) and a second electrode connected to a second node N2 (source of NT1). The discharge unit includes a fourth NMOS transistor NT4 having a gate connected to the control terminal CT (G02), a drain connected to the first node N1, and a source connected to the ground voltage terminal VSS so as to be able to selectively drive N1 low when GO2 goes high.

If a start pulse STVP is inputted to the input terminal IN, the third transistor NT3 is turned on in response to the pulse input and the first capacitor C1 is thereby charged with the start pulse STVP. If the first capacitor C1 is charged over a threshold voltage of the first transistor NT1, the first transistor NT1 is turned on and then outputs a high level corresponding to the noninverted gate clock pulse CKV, which high level (VON) is to be provided to the output terminal OUT at the appropriate time.

In this case, a potential of the first node N1 becomes bootstrapped to track potential variations of the second node N2 due to coupling by the charged first capacitor C1 from N2 to N1. Accordingly if there is an abrupt downward potential change on the second node N2 due for example to NT2 turning on, the potential on N1 will head downward as well. On the other hand, if there is an abrupt upward potential change on the second node N2 due for example to GO1 going high, the potential on N1 will head upward as well. So, the first transistor NT1 is facilitated to output the first gate clock pulse CKV applied to the drain to the output terminal OUT when GO1 starts going high in response to NT3 charging up the first capacitor C1. The gate clock pulse CKV outputted to the output terminal OUT becomes the gate driving signal GO1 provided to a gate line. The start pulse STVP is used as a signal for preliminarily charging the first capacitor C1 and thus turning on the first transistor NT1 to generate a first going high gate driving signal GO1.

Subsequently, if the fourth transistor NT4 is turned on in response to the gate driving signal G02 as the output signal of the second stage which is inputted via the control terminal CT, charges in the first capacitor C1 are discharged to a level of a gate-off voltage VOFF provided via the ground voltage terminal VSS.

The holding unit 132*d* includes fifth and sixth transistors NT5 and NT6 for holding the gate driving signal GO1 in a status of the gate-off voltage (VOFF) level. The fifth transistor NT5 has a gate connected to a third node N3, a drain connected to the second node N2, and a source connected to the ground voltage terminal VSS. The sixth transistor NT6 has a gate connected to the second clock terminal CK2, a drain connected to the second node N2, and a source connected to the ground voltage terminal VSS.

The switching unit 132*e* includes seventh to tenth transistors NT7 to NT10 and second and third capacitors C2 and C3 to control the holding unit 132*d* to be driven. The seventh transistor NT7 has gate and drain connected to the first clock terminal CK1 and a source commonly connected to a drain of the ninth transistor NT9 and a gate of the eighth transistor NT8. The eighth transistor NT8 has a drain connected to the first clock terminal CK1, a gate connected to the drain of the seventh transistor NT7 via the second capacitor C2, and a source connected to the third node N3. In particular, the gate and the source of the eighth transistor NT8 are connected to each other via the third capacitor C3. The ninth transistor NT9 has a drain connected to the source of the seventh transistor NT7, a gate connected to the second node N2, and a source connected to the ground voltage terminal VSS. The tenth transistor NT10 has a drain connected to the third node N3, a gate connected to the second node N2, and a source connected to the ground voltage terminal VSS.

If a gate clock pulse CKV in a high state is outputted to the output terminal OUT as the gate driving signal G0, a potential of the second node N2 is raised to a high state. If the potential of the second node N2 is raised to the high state, each of the ninth and tenth transistors NT9 and NT10 is switched to a turned-on mode. In this case, although both of the seventh and eighth transistors NT7 and NT8 are switched to the turned-on state by the gate clock pulse CKV provided to the first clock terminal CK1, signals outputted from the seventh and eighth transistors NT7 and NT8 are discharged to a ground voltage (VOFF) state via the ninth and tenth transistors NT9 and NT10, respectively. Since the potential of the third node N3 is maintained at the low state while the gate driving signal GO1 of the high state is outputted, the fifth transistor NT5 can maintain the turned-on state.

Subsequently, when the high state of the gate driving signal GO1 is discharged via the ground voltage terminal VSS in response to the gate driving signal GO2 going high, the potential of the second node N2 gradually falls to a low state. So, each of the ninth and tenth transistors NT9 and NT10 is switched to a turned-off state and a potential of the third node N3 is raised to a high state by signals outputted from the seventh and eighth transistors NT7 and NT8. As the potential of the third node N3 is raised, the fifth transistor NT5 becomes turned on. And, the potential of the second node N2 is discharged to a gate-off voltage (VOFF) state via the fifth transistor NT5.

While this status is maintained, if the sixth transistor NT6 is turned on by the inverted gate clock bar pulse CKVB provided to the second clock terminal CK2, the potential of the second node N2 can be discharged via the ground voltage terminal VSS more surely.

Consequently, the fifth and sixth transistors NT5 and NT6 of the holding unit 132*d* hold the potential of the second node N2 at the gate-off voltage (VOFF) state. And, the switching unit 132*e* decides a timing point at which the fifth transistor NT5 is turned on.

The carry unit 132*f* includes an eleventh transistor NT11 having a drain connected to the first clock terminal CK1, a gate connected to the first node N1, and a source connected to the carry terminal CR. The eleventh transistor NT11 is turned on as the potential of the first node N1 rises. The eleventh transistor NT11 then outputs a gate clock pulse CKV inputted to the drain as a carry signal CAsig1. The carry signal is provided to an input terminal of a next stage to be used as a start pulse for driving the next stage.

The first stage STAGE1 further includes a ripple preventing unit 132*g* and a reset unit 132*h*. The ripple preventing unit 132*g* prevents the gate driving signal GO1 already maintained at the gate-of voltage (VOFF) state from being rippled by noise inputted via the input terminal IN. For this, the ripple preventing unit 132*g* includes a twelfth and thirteenth transistors NT12 and NT13. The twelfth transistor NT12 has a drain connected to the input terminal IN, a gate connected to the second clock terminal CK2, and a source connected to the first node N1. The thirteenth transistor NT13 has a drain connected to the first node N1, a gate connected to the first clock terminal CK1, and a source connected to the second node N2.

The reset unit 132*h* includes a fourteenth NMOS transistor NT14 having a drain connected to the first node N1, a gate connected to the reset terminal RE, and a source connected to the ground voltage terminal VSS. The fourteenth transistor NT14 causes the second node N2 to become discharged to the gate-off voltage (VOFF) state in response to the reset signal REsig going high, where the latter is an output signal of the $(n+1)^{th}$ stage STAGEn+1. Since the reset signal REsig corresponding to the output signal of the $(n+1)^{th}$ stage STAGEn+1 means an end of one frame, activation of the reset unit 132*h* corresponds to all the first nodes N1 of all the stages STAGE1 to STAGEn being driven low simultaneously at the timing point at which one frame ends.

In particular, the reset unit 132*h* resets the first nodes N1 of the stages STAGE1 to STAGEn in a manner of turning on the fourteenth transistors NT14 of the stages STAGE1 to STAGEn by the output signal of the $(n+1)^{th}$ stage STAGEn+1 after completion of outputting the gate driving signals from the stages STAGE1 to STAGEn sequentially. Hence, the stages STAGE1 to STAGEn of the circuit unit 132 can restart their operations in a reset state.

In the illustrated embodiment, the reset signal REsig is used as a feed back signal to the timing controller 170 for allowing the controller 170 to measure the delay time between activation of the first stage of the shift register (by way of an OE signal) and the subsequent, ripple-induced activation of the dummy gate driving signal due to inherent delays within the gate driving circuit and to then calculate the approximate per-display-row accumulating delay associated with the stages of the shift register. Of course, it is to be understood that all of the second to $(n+1)^{th}$ stages shown in FIG. 5 are implemented with the same internal configuration of the above-explained first stage of FIG. 6. So, details of the second to $(n+1)^{th}$ stages are omitted in the following description.

Figure 7:
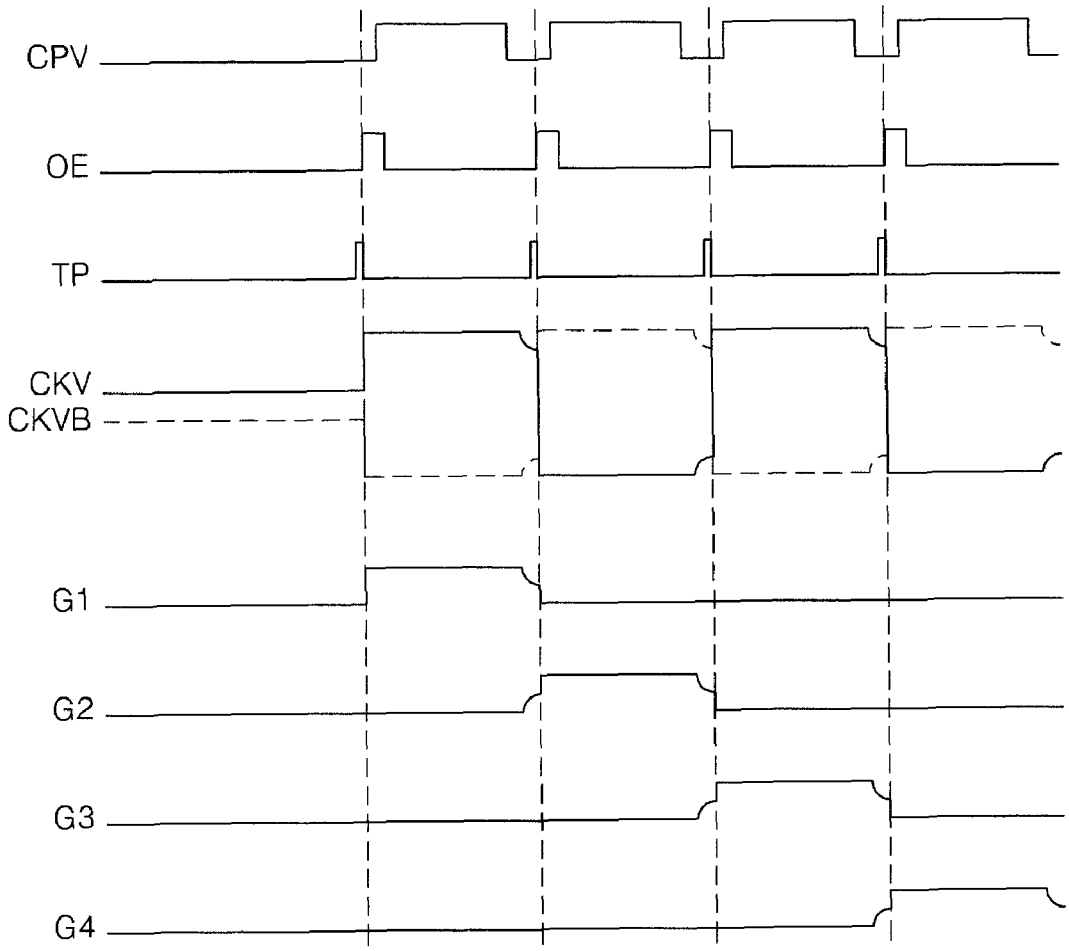
FIG. 7 is an operational timing diagram of the LCD device shown in FIG. 1.

FIG. 7 is an operational timing diagram (voltage levels versus a common time line) of the LCD device shown in FIG. 1.

Referring to FIG. 7, the first and second level shifters 150 and 160 generate the noninverted gate clock pulse CKV and the inverted gate cock bar pulse CKVB with the gate-on voltage level VON and the gate-off voltage level VOFF by performing the above-described OR operation on the output enable signal OE and the gate clock signal CPV provided by the timing controller 170. Each of the odd-numbered stages STAGE1, STAGE3, . . . , and STAGEn+1 of the first and second gate driving circuits 130 and 140 outputs a gate clock pulse CKV as a gate driving signal. Each of the even-numbered stages STAGE2, STAGE4, . . . , STAGEn outputs a gate clock bar pulse CKVB as a gate driving signal.

The timing controller 170 enables the data driving circuit 120 to provide a gray scale display voltage to the data line in a manner of synchronizing a falling timing point of a load signal TP at a timing point at which a gate driving signal sequentially provided to each of the gate lines GL1 to GLn rises to a high level. If the gate driving signal is delayed by inherent delays within the gate driving circuits 130 and 140, the falling timing point of the load signal TP is correspondingly delayed by an amount of time compensating for the propagation delay of the gate driving circuits 130/140. Hence, the feedback system is able to solve the problem caused by the gate driving signals being differently delayed by the gate driving circuits 130 and 140 depending on factors such as variation in fabrication process, variation in temperature, variation in power supply levels and so on.

Figure 8:
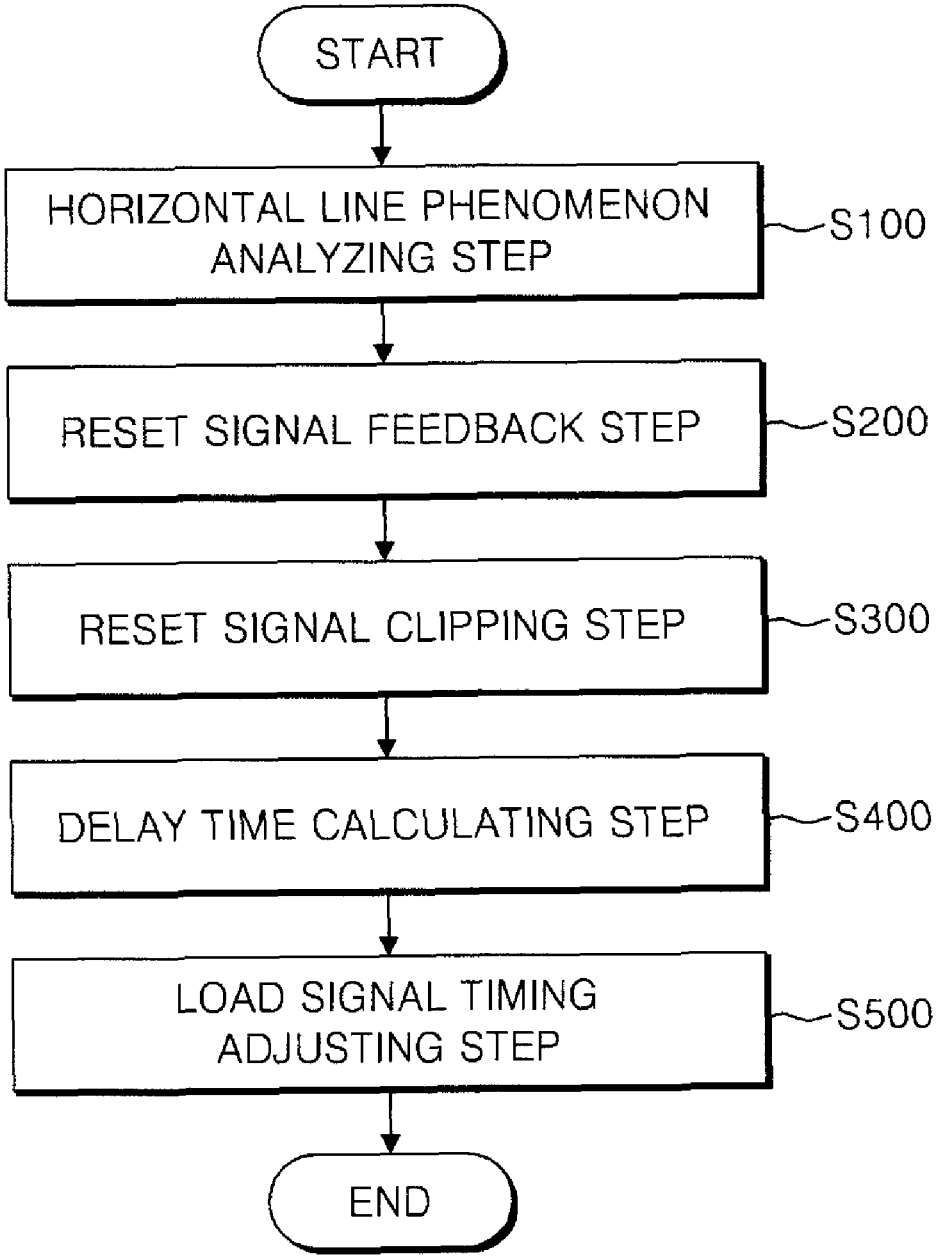
FIG. 8 is a flow chart of a method of decreasing ASG delay according to one embodiment of the present disclosure.

A method of compensating for a delay caused by a gate driving circuit in a manner of feeding back a reset signal of a gate driving circuit using an LCD device according to one embodiment is explained in detail with reference to FIGS. 8 and 9A to 9D as follows. FIG. 8 is a flowchart of a method of decreasing ASG delay according to one embodiment while FIGS. 9A to 9D are timing diagrams of signals to explain the ASG delay decreasing method shown in FIG. 8.

Referring to FIG. 8, a method of decreasing ASG delay according to one embodiment includes a horizontal line phenomenon analyzing step S100, a rest signal feedbacking step S200, a reset signal clipping step S300, a delay time measuring and calculating step S400, and a load signal timing adjusting step S500.

In the horizontal line phenomenon analyzing step S100, when the gate driving circuits 130 sequentially apply gate driving signals to the gate lines GL1 to GLn, a horizontal line phenomenon, which occurs if a gate driving signal is applied later than a data output due to delays of the gate driving circuits 130 and 140, is analyzed.

Referring to FIG. 9A, outputs of the gate driving signals provided to the gate lines GL1 to GLn are gradually (cumulatively) delayed due to rippling of sequential GO signals toward the lower part of the LCD panel 110 where the cumulative delays are due to individual delays of the gate driving circuits 130 and 140 themselves. For instance, while gate lines are sequentially driven, if a gray scale display voltage corresponding to red (R), green (G) or blue (B) is supplied to a pixel connected to the corresponding gate line, a gate driving signal tends to be more delayed toward the lower part of the LCD panel 110 than near its top as is indicated in FIG. 9A. So, the pixel connected to the corresponding lower gate line might be incorrectly displayed as a color different from an original color supposed to be displayed if the cumulative delay is large enough.

In case that gate lines G2 and Gn−1, to which a gray scale display voltage for green (G) is applied, are compared to each other, pixels connected to the gate line G2 are normally provided with a gray scale display voltage corresponding to green for a section having a gate driving signal GO2 in a high level. Yet, a gray scale display voltage corresponding to blue as well as a gray scale display voltage corresponding to green is simultaneously provided to pixels connected to the gate line Gn−1. So, it is unable to display a color supposed to be originally displayed. This is because a gate driving signal is applied later than a data output due to the self-delays of the gate driving circuits 130 and 140. Hence, the above-mentioned problem can be solved in a manner of compensatingly delaying the timing of the data load signal to approximately match the accumulative delay times of the gate driving signal attributed to the self-delays of the gate driving circuits 130 and 140.

The reset signal feedbacking step S200 is the step of providing the clipping unit 190 with a reset signal REsig as an output signal of the dummy stage STAGEn+1 of the gate driving circuits 130 and 140. In particular, referring to FIG. 9B, compared to the hypothetical output signal XREsig of the dummy stage STAGEn+1 in case that no delay is generated by the gate driving circuits 130 and 140, a reset signal REsig is delayed by a predetermined delay duration, DELAY in case that a delay of a gate driving signal is generated by the gate driving circuit 130/140. In this case, 'OE' and 'CVP' respectively indicate an output enable signal and a gate clock signal used to generate the hypothetical output signal XREsig.

The reset signal clipping step S300 is the step of clipping a reset signal REsig to a predetermined voltage level via the clipping unit 190 and then providing the clipped signal to the timing controller 170. Referring to FIG. 9C, since the reset signal REsig has a gate-on voltage VON and a gate-off voltage VOFF, a clipped reset signal CREsig is generated by converting the reset signal REsig to a signal at voltage levels controllable in the timing controller 170, e.g., a signal at 0V and 3.3V.

The delay time calculating step S400 is the step of measuring and calculating a delay time of a gate driving signal using the clipped reset signal CREsig and a last output enable signal LASTOE. If there is no delay of the gate driving signal, a reset signal REsig outputted from the dummy stage STAGEn+1 is outputted at a rising timing point of the last output enable signal LASTOE and data should be outputted at a falling timing point of a load signal TP. So, it is able to calculate the delay time of the gate driving signal using the clipped reset signal CREsig and the last output enable signal LASTOE. In this case, the measured delay time obtained from the gate driving signal of the dummy stage is used to calculate the per-row delay and the latter is repeatedly used to cumulatively over time adjust the timing of the falling edge of the load signal TP so as to approximately match the cumulative delays produced over time by the VON level rippling through the STAGe1 through STAGen of the shift register.

The delay time of the gate driving signal can be calculated via Formulas 1 to 3 as follows.

$$1H_{ideal}=1\text{Frame}_{ideal}\div Gn \qquad \text{[Formula 1]}$$

In Formula 1, $1H_{ideal}$ is a one-horizontal cycle in case that it is assumed there is no delay caused by the gate driving circuit 130 or 140, $1\text{Frame}_{ideal}$ is a one-frame cycle in case that there is no delay caused by the gate driving circuit 130 or 140, and Gn is the number of total gate lines driven by the shift register.

$$1H_{real}=1\text{Frame}_{real}\div Gn \qquad \text{[Formula 2]}$$

In Formula 2, $1H_{real}$ is a one-horizontal cycle in case that there is a delay caused by the gate driving circuit 130 or 140, $1\text{Frame}_{real}$ is a one-frame cycle in case that there is a delay caused by the gate driving circuit 130 or 140, and Gn is the number of total gate lines.

$$T_{TP}=1H_{ideal}\times Gm+(1H_{real}-1H_{ideal})\times Gm\div Gn \qquad \text{\{Formula 3\}}$$

In Formula 3, $1T_{TP}$ is a timing point at which data should be applied to a pixel connected to an $m^{th}$ gate line, i.e., a falling timing point of a load signal and Gm is the $m^{th}$ gate line.

Referring to FIG. 9D, a delay time of a gate driving signal is calculated by measuring the delay between a clipped reset signal CREsig and the last output enable signal LASTOE.

If there is no delay caused by the gate driving circuit 130 or 140, a rising timing point of the clipped reset signal CREsig should be equal to that of the last output enable signal LASTOE. However, since the reset signal REsig is outputted in a manner of being inherently delayed by rippling through of signals through the physical gate driving circuit 130 or 140, the rising point of the clipped reset signal CREsig is typically not matched (when measured) with that of the last output enable signal LASTOE.

So, the delay time of the gate driving signal can be calculated in a manner of comparing the rising timing point of the clipped reset signal CREsig to that of the last output enable signal LASTOE, counting a system clock count corresponding to an interval from the rising point of the output enable signal LATOE to the rising timing point of the clipped reset signal CREsig, and then generating a corresponding clock count signal CLOCKCOUNT.

The load signal timing adjusting step S500 is the step of adjusting a falling timing point of a load signal TP in response to the clock count signal CLOCKCOUNT that represents the measured ripple-through delay of the shift register. For instance, if the number of gate lines is 768 and if the clock count signal CLOCKCOUNT is 40, it is calculated into 768/40 (total lines)/(total clock pulses)=19.2 lines per one clock pulse. Hence, it can be observed that a ripple-through delay is generated by the shift register corresponding to 1 clock per every 19.2 lines that are scanned by the shift register. If this is rounded up, a cumulative TP adjusting delay of 1 clock per every 20 consecutive lines can be generated as the approximate adjustment amount per every 20 display lines that are scanned by the shift register.

Accordingly, data is outputted to pixels connected to the first to $20^{th}$ gate lines GL1 to GL20 in a manner of synchronizing a falling timing point of a load signal TP with a rising timing point of an output enable signal OE corresponding to each gate line. And, data is outputted to pixels connected to the $21^{st}$ to $40^{th}$ gate lines GL21 to GL40 in a manner of synchronizing a falling timing point of a load signal TP with a timing point delayed by 1 clock period in this exemplary case behind a rising timing point of an output enable signal OE corresponding to each gate line.

Moreover, data is outputted to pixels connected to the $41^{st}$ to $60^{th}$ gate lines GL21 to GL40 in a manner of synchronizing a falling timing point of a load signal TP with a timing point delayed by two (2) clocks behind a rising timing point of an output enable signal OE corresponding to each gate line. Besides, a falling timing point of a load signal TP is adjusted in the above manner for the pixels connected to the rest of the gate lines GL61 to 768, whereby a delay of a gate driving signal caused by the gate driving circuit 130 or 140 can be compensated for.

In other words, by adjusting a falling timing point of a load signal TP outputted by one-horizontal cycle using a set 1-frame time and an actual timing point at which a reset signal REsig is outputted from a dummy stage STAGEn+1, a delay of a gate driving signal caused by a self-delay of the gate driving circuit 130 or 140 can be compensated for.

As described above, gate lines are dually driven by a pair of gate driving circuits which are identical and provided to both sides of the gate lines. And, a reset signal of the gate driving circuit is fed back. Accordingly, the disclosed design compensates for a ripple-through delay which is caused by the serially-connected stages of the gate driving circuit.

It will be apparent to those skilled in the art in view of the present disclosure that various modifications and variations can be made in the disclosed embodiments without departing from the spirit or scope of the present teachings. Thus, it is intended that the present teachings cover such modifications and variations.

What is claimed is:

1. A liquid crystal display (LCD) device having a plurality of display rows, a plurality of display columns, and a plurality of pixels, where said pixels are defined by the display rows and the display columns, the LCD device further comprising:

a timing controller configured to generate a gate driving circuit output enabling signal and a gate driving circuit clocking signal, the timing controller being further configured to variably adjust a timing of a data load signal output thereby, where the data load signal determines a timing point when display data signals will be output for the display columns of a correspondingly activated display row;

a level shifter, operatively coupled to the timing controller and configured to generate gate driving circuit clock pulses in response to the output enabling signal and the gate driving circuit clocking signal generated by the timing controller;

a gate driving circuit, responsive to the gate driving circuit clock pulses of the level shifter and configured to sequentially activate the display rows one after the next by sequentially activating a plurality of gate lines one after the next, by generating a first gate driving signal in response to the gate driving circuit clock pulses generated by the level shifter, said gate driving circuit including a shift register having a plurality of stages which are dependently connected to each other; and a clipping unit, operatively interposed between the gate driving circuit and the timing controller, the clipping unit being configured to provide the timing controller with a second gate driving signal generated by clipping the first gate driving signal in response to the to-be-clipped first gate driving signal being output from a last stage of the gate driving circuit, wherein the timing controller is configured to variably adjust the timing of the data load signal by measuring and calculating a delay time associated with the first gate driving signal that is output from the last stage of the gate driving circuit by comparing a timing of the second gate driving signal with a timing of the output enabling signal, wherein the gate driving circuit is configured to operate in accordance with a first digital signaling range having a predetermined gate-on voltage level and a predetermined gate-off voltage level, wherein the level shifter is configured to generate the gate driving circuit clock pulses also in accordance with the first digital signaling range having the gate-on voltage level and the gate-off voltage level, wherein the level shifter is further configured to generate gate driving circuit clock bar pulses in accordance with the first digital signaling range, where the clock bar pulses have an inverted phase with respect to a phase of the gate driving circuit clock pulses, and wherein the first gate driving signal comprises a reset signal for resetting the gate driving circuit.

2. The liquid crystal display device of claim 1, wherein the gate driving circuit is integrated on a liquid crystal display panel having the gate lines formed thereon and is dually formed at both ends of the gate lines to dually drive the gate lines.

3. The liquid crystal display device of claim 1, wherein a last one of the plurality of stages is a dummy stage configured to generate the reset signal.

4. The liquid crystal display device of claim 3, wherein the timing controller comprises:

an output enable signal generator providing a last output enable signal of one frame;

a counter generating a clock count signal by comparing a clipped reset signal resulted from clipping the reset signal and the last output enable signal of the one frame; and a load signal generator adjusting the timing of the load signal in response to the clock count signal.

5. A liquid crystal display (LCD) device having a plurality of gate lines that are sequentially activated one after a next and a plurality of data lines through which data signals are transferred to corresponding pixels of the activated gate line, the LCD device comprising:

a gate driving circuit comprising a shift register having a plurality of stages which are dependently connected to each other and connected to the plurality of gate lines, respectively, the gate driving circuit being configured to sequentially generate gate driving signals which activate respective ones of the gate lines and to generate a reset signal which resets all the gate driving signals, wherein the reset signal is generated from the last stage of the gate driving circuit and the gate driving signals and the reset signal are in accordance with a first digital signaling range having a predetermined gate-on voltage level and a predetermined gate-off voltage level; and a timing controller configured to calculate a delay time of one of the gate driving signals by comparing a timing of the reset signal which is used by the gate lines driving circuit with a timing of and an output enable signal that initiates the last stage of the gate driving circuit, the timing controller being further configured to adjust a timing of a load signal for deciding a data output timing point in response to the delay time.

6. The liquid crystal display device of claim 5, further comprising a clipping unit configured to convert the reset signal of the first digital signaling range into a clipped reset signal operating in accordance with the second signaling range, the clipping unit being coupled to the timing controller to provide the timing controller with the clipped reset signal.

7. The liquid crystal display device of claim 6, the timing controller comprising:

an output enable signal generator providing the output enable signal;

a counter generating a clock count signal by comparing the clipped reset signal and a last output enable signal of one frame; and a load signal generator adjusting the timing of the load signal in response to the clock count signal.

8. The liquid crystal display device of claim 7, wherein the last stage is a dummy stage configured to generate the reset signal.

9. The liquid crystal display device of claim 8, wherein the counter generates as the clock count signal the number of clocks corresponding to an interval from a rising timing point of the output enable signal to a rising timing point of the clipped reset signal.

10. The liquid crystal display device of claim 9, wherein the load signal generator calculates a delay time of the gate driving signal by dividing the number of gate lines provided with the gate driving signal by a value of the clock count signal and delays a falling timing point of the load signal corresponding to the calculated delay time of the gate driving signal.

* * * * *